US005646636A

United States Patent [19]

Saldell et al.

[11] Patent Number: 5,646,636

[45] Date of Patent: Jul. 8, 1997

[54] ANTENNA MOUNTING ON WINDOWS

[75] Inventors: Ulf Saldell, Österskär; Håkan Bergquist; Gunnar Engblom, both of Åkersberga, all of Sweden

[73] Assignee: Allgon AB, Akersberga, Sweden

[21] Appl. No.: 392,919

[22] PCT Filed: Sep. 3, 1993

[86] PCT No.: PCT/SE93/00719

§ 371 Date: Mar. 3, 1995

§ 102(e) Date: Mar. 3, 1995

[87] PCT Pub. No.: WO94/06169

PCT Pub. Date: Mar. 17, 1994

[30] Foreign Application Priority Data

Sep. 4, 1992 [SE] Sweden ..... 9202551

[51] Int. Cl.[6] ..... H01Q 1/32; H01Q 1/12

[52] U.S. Cl. ..... 343/713; 343/715; 343/888

[58] Field of Search ..... 343/713, 711, 343/715, 900, 904, 905, 906, 888; H01Q 1/32, 1/12

[56] References Cited

U.S. PATENT DOCUMENTS

| | | | |
|---|---|---|---|
| 4,658,259 | 4/1987 | Blaese | 343/715 |
| 4,779,098 | 10/1988 | Blaese | 343/713 |
| 4,785,305 | 11/1988 | Shyu | 343/713 |
| 4,862,183 | 8/1989 | Blaese | 343/715 |
| 4,931,806 | 6/1990 | Wunderlich | 343/715 |
| 4,992,800 | 2/1991 | Parfitt | 343/713 |
| 5,032,846 | 7/1991 | Chang | 343/882 |
| 5,278,572 | 1/1994 | Harada et al. | 343/713 |

FOREIGN PATENT DOCUMENTS 2546673 11/1984 France .

*Primary Examiner*—Hoanganh T. Le

*Attorney, Agent, or Firm*—Jacobson, Price, Holman & Stern, PLLC

[57] ABSTRACT

A known mounting for attaching an antenna pole to a motor vehicle window comprises an antenna mounting plate which is fitted to the outside of the window glass and an inner plate which is fitted to the inside of the window glass. The inner plate includes an antenna connector and a connector for connecting a coaxial cable to a receiver/transmitter. With the intention of simplifying the antenna mounting in a manner which will enable the antenna pole to be readily removed but nevertheless to be securely held when the vehicle is in use, and also with intention of eliminating the deleterious effect of atmospheric conditions on the mounting and the component parts thereof, so as to prevent corrosion or rusting, the mounting plate is made of an electrically non-conductive material and has formed integrally therewith an attachment which coacts slidable with an antenna-carrying attachment piece. The mounting plate has an outer contour which corresponds to the outer contour of the inner plate, this plate also being made of an electrically non-conductive material.

3 Claims, 3 Drawing Sheets

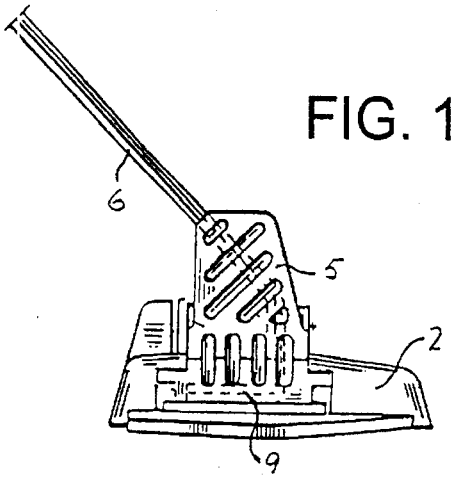
FIG. 11
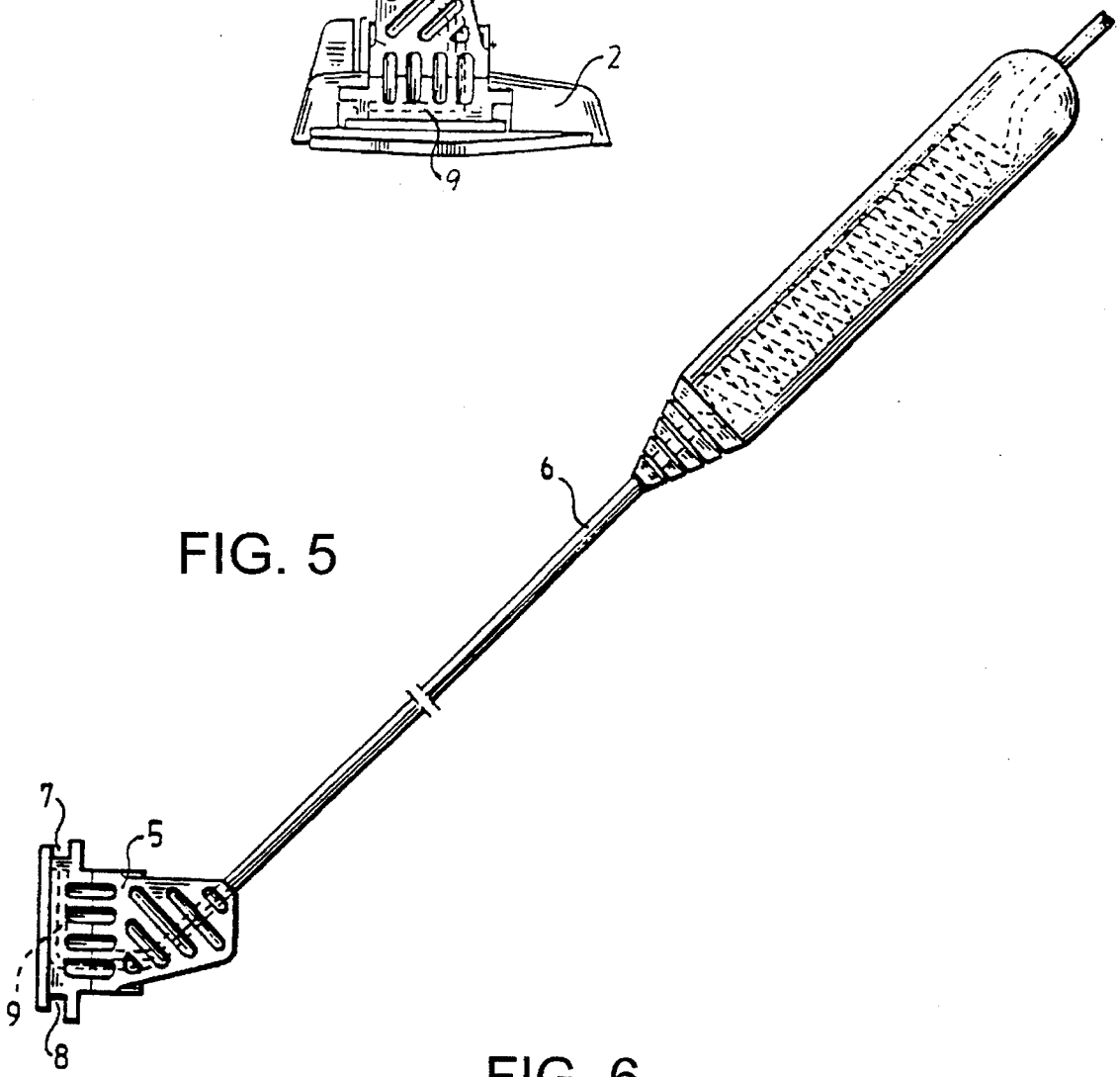
FIG. 5
FIG. 6
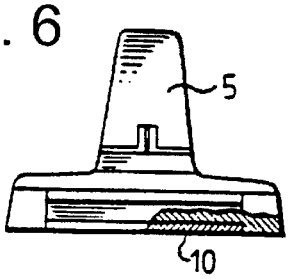

ANTENNA MOUNTING ON WINDOWS

BACKGROUND OF THE INVENTION

The present invention relates to an antenna mounting for attaching an antenna or antenna post to a window of a motor vehicle, said mounting including an antenna attachment plate which is intended to be mounted onto the outer surface of the window, an inner plate which is intended to be mounted onto the inner surface of the window, antenna connecting means and means for connecting a coaxial cable to a receiver/transmitter.

Antenna mountings of this kind are known to the art from U.S. Pat. No. 4,931,806, for instance. In the case of this known antenna mounting, the antenna pole is attached to a mounting plate on the outside of the window by means of a screw connection. The screw connection, the mounting plate and the antenna pole attachment piece are all made of metal. These components are thus exposed to the effect of ambient elements and the antenna pole is easily broken unintentionally by catching in some external object. The metal components are also affected by atmospheric conditions, which may render the screw connection difficult to loosen or remove when wishing to remove the antenna pole.

SUMMARY OF THE INVENTION

An object of the present invention is to simplify the antenna mounting so that while enabling the antenna pole to be easily removed from its mounting it will nevertheless remain safely secured when the vehicle is in use. Neither shall atmospheric conditions have a corrosive effect on the mounting and its components. Another object of the invention is to provide a simple and reliable coupling system between antenna and coaxial cable to the receiver/transmitter such as to take-up the minimum of space. The antenna mounting shall thus not be bulky or require excessive window space.

These objects are achieved in accordance with the invention with an antenna mounting having the characteristic features set forth in the following Claims.

The invention will now be described in more detail with reference to a suitable exemplifying embodiment thereof and also with reference to the accompanying drawings.

BRIEF DESCRIPTION OF DRAWINGS

FIG. 5 is a side view of the antenna pole and its attachment piece. FIG. 6 illustrates the attachment piece from one side and at an angle of 90° in relation to the view shown in FIG. 5.

FIG. 11 illustrates the attachment piece and antenna pole attached to the mounting plate.

DESCRIPTION OF PREFERRED EMBODIMENT

Figure 1:
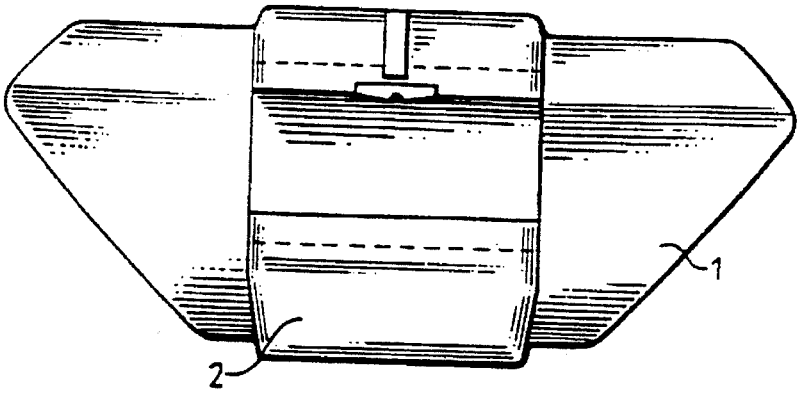
FIG. 1 illustrates the mounting plate from above and FIG. 2 illustrates the mounting plate from beneath, i.e. towards the side of the plate that lies against the window.
Figure 2:
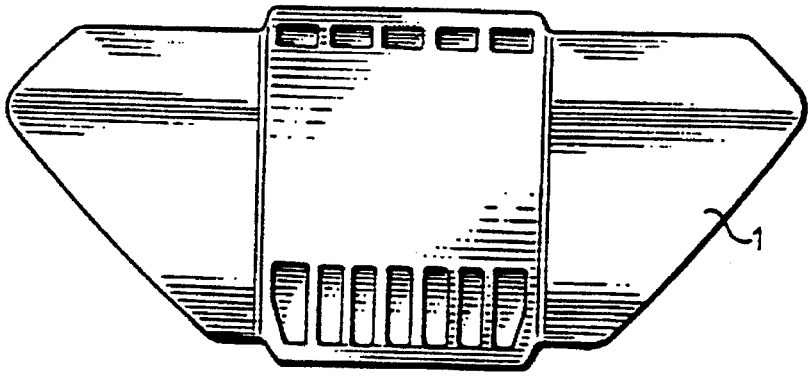
Figure 3:
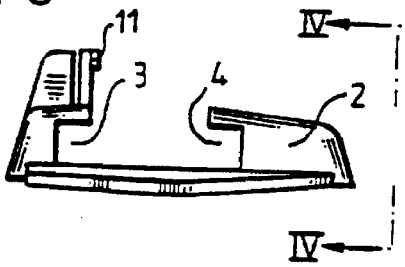
FIG. 3 is a side view of the mounting plate and FIG. 4 is a side view taken at an angle of 90° in relation to the side view of FIG. 3.
Figure 4:
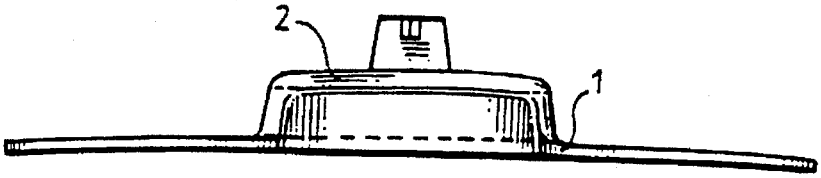

The mounting plate 1 is an integral unit made of an electrically non-conductive material and having a triangular shape in plane. The underside of the plate 1 is flat and is intended to be affixed directly to the window glass with the aid of a suitable fastening means. The mounting plate has an integrated attachment 2 on the side thereof distal from the window glass, this attachment 2 being located centrally of the mounting plate. The attachment 2 is shown in side view in FIG. 3. As will be seen from FIG. 2, the attachment includes two mutually parallel grooves or channels 3 and 4 which extend parallel with the plane of the mounting plate. FIG. 4 illustrates the mounting plate and the attachment from the direction indicated by the arrow IV in FIG. 3. The attachment 2 is intended to carry a removable and slidable attachment piece 5 in which the antenna pole 6 is rigidly fitted, see FIG. 5. The attachment piece 5 includes rails 7 and 8 which extend along two mutually opposing sides of the attachment piece and fit into respective grooves 3 and 4 in the attachment 2. The rails 7 and 8 of the illustrated embodiment have a U-shaped cross-section. The bottom part of the antenna pole 6 is moulded in the attachment piece 5 and is curved so as to form a pole-extension 9 which extends parallel to the plane formed by the rails 7 and 8. The pole-extension 9 is preferably secured to a metal plate 10, e.g. soldered thereto, see FIG. 6, such as to form a coupling device which forms part of the coupling means between the antenna and the coaxial cable on the other side or inside of the window glass. FIG. 6 shows the attachment piece as seen in a direction perpendicular to the side view of FIG. 5. The attachment piece is made of an electrically non-conductive material.

The attachment 2 and the attachment piece 5 are thus intended for mounting the antenna pole 6 onto the mounting plate 1, which is effected by inserting the rails 7 and 8 into the grooves 3 and 4 in the attachment 2 from one side of the mounting plate 1. The attachment 2 and the attachment piece 5 may be configured to achieve some form of snap engagement therebetween, as indicated in FIG. 3 by means of a pin 11. The intention is that the attachment piece 5 can be readily pushed from the attachment 2 by hand when wishing to remove the antenna pole, for instance when washing the vehicle and in order to prevent the antenna pole being stolen. When using an attachment and an attachment piece of the illustrated configuration and when producing said parts from an appropriate material, corrosion of the parts is avoided and the antenna pole can be fitted and removed easily. It must also be ensured that the slip stream engendered by the vehicle in motion will not loosen the antenna pole from the mounting plate.

Figure 7:
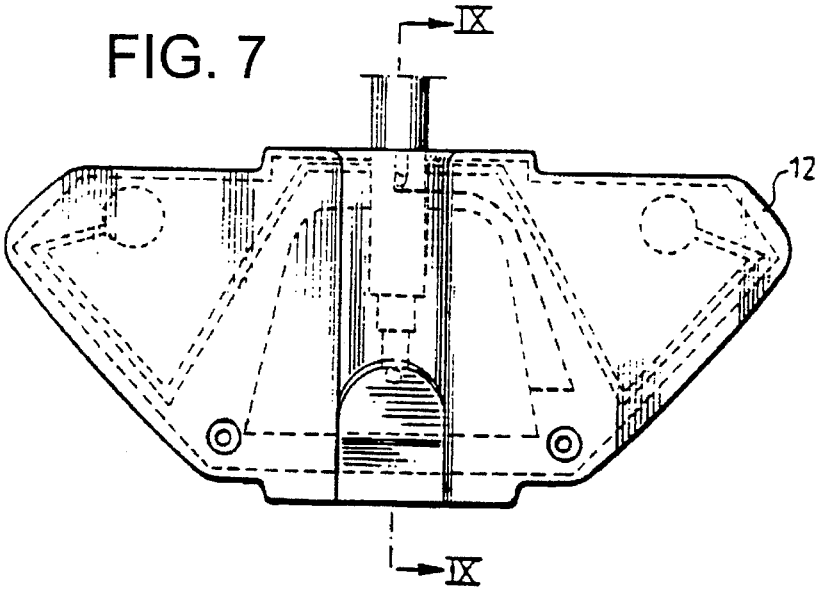
FIG. 7 illustrates the inner plate as seen towards the side which lies distal from the window when mounted.
Figure 10:
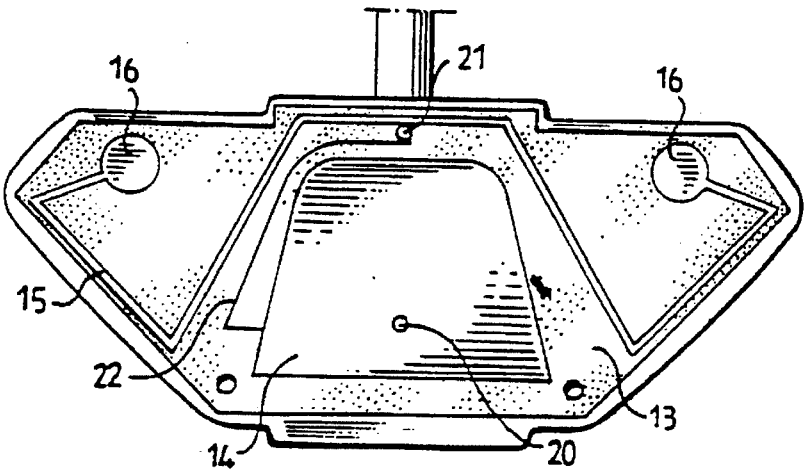
FIG. 10 illustrates a printed circuit board as seen from the side thereof which lies against the window and thus against the mounting plate and the antenna.

FIG. 7 is a plan view of the inner plate which is fitted onto the inside of the window glass and which carries the end of the coaxial cable to the receiver/transmitter to be connected to the radio antenna. The inner plate 12 has the same outer contours as the mounting plate 1. The inner plate is made of an electrically non-conductive material. Fitted to or moulded in the side of the inner plate 12 that lies against the window glass is a circuit board 13, see FIG. 10. The circuit board is shown in broken lines in FIG. 7 and FIG. 7 shows the inner plate 12 as seen towards that side thereof which faces away from the window glass. A metal plate 14 is mounted in the centre of the circuit board 13.

The metal plate 14 forms a connection plane with the antenna 6 and its optional metal plate 10. The circuit board also carries an earth plane 15 in the form of wire disposed in folds around the metal plate 14. The ends of the wire are enlarged by flattening said ends, as shown at 16.

Figure 8:
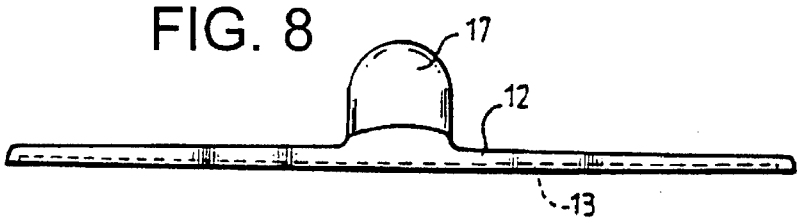
FIG. 8 is a side view of the inner plate.
Figure 9:
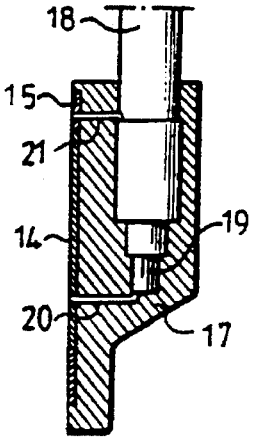
FIG. 9 is a side view of the inner plate as seen from the left in the plane of the drawing.

FIG. 9 is a cross-sectional view of the inner plate taken on the line IX—IX in FIG. 7. As will be seen from the side view shown in FIG. 8, a thickening 17 extends centrally across the inner plate. This thickening 17 is also shown in FIG. 9. The thickening is an integral part of the inner plate, for instance a moulded part, in which the free end of the coaxial cable 18 is moulded. The coaxial cable is thus connected electrically with the components on the circuit board 13, these connections being shown in FIGS. 9 and 10. Thus, the centre conductor 19 of the coaxial cable 18 is connected to the metal plate (the connection plane) 14 by means of a wire 20. The metal sheath (not shown) of the coaxial cable is connected by means of a wire 21 to the earth plane in the form of a wire 15. Between the metal plate 14 and the earth plane 15, there is provided an electric coupling 22, the electrical properties of which are included in the impedence adaptation to the coaxial cable 18.

The electrical length of the earth plane corresponds to a quarter of a wavelength, although the material length of the earth plane, i.e. the extension of the wire 15, is much smaller than one-quarter of a wavelength.

As will be seen from FIG. 8, the circuit board 13 is fitted closely to the inner plate 12, so as to form a thin and smooth platform. The mounting plate is secured with the aid of an appropriate fastener means, for instance double-sided adhesive tape, with the circuit board facing towards the window glass and therewith opposite the place where the mounting plate 1 is fitted. The result is an antenna pole mounting with which the radio coupling is formed by the lower part of the antenna and a metal plate when used, together with the metal plate 14 of the circuit board. There is thus formed a so-called capacitor coupling. The dielectric plate between the metal parts is formed by the window glass (not shown). The requisite earth plane is thus found in the circuit board, and the coaxial cable coupling for connection to the receiver/transmitter is comprised of the inner plate 12.

We claim:

1. A mounting for fitting an antenna pole including an antenna wire to a window glass, comprising an antenna mounting plate having a plane side which is intended to be fitted to an outer surface of said window glass, an inner plate which is intended to be fitted to an inner surface of said window glass and which includes antenna coupling means and means for connecting a coaxial cable to a receiver/transmitter, said mounting plate and said inner plate having corresponding outer contours and a connecting piece carrying the antenna pole, said mounting plate being made of an electrically non-conductive material and having integral therewith an attachment means for receiving the connecting piece with a sliding connection, said antenna wire having a curved end portion located in said connecting piece so as to extend parallel with said plane side of said mounting plate and form a capacitive coupling means with a coupling plane on said inner plate when the connecting piece is connected to the mounting plate by said sliding connection.

2. A mounting as defined in claim 1, wherein said attachment means includes two parallel rails forming guides to coact with grooves in said mounting plate and which are parallel with said plane side of said mounting plate.

3. A mounting as defined in claim 1, wherein the connecting piece has a metal plate which is joined to the antenna wire and which when attached to the mounting plate extends parallel with the plane of said mounting plate and forms a part of said capacitive coupling with said coupling plane on the inner plate.

* * * * *